United States Patent [19]

Fassler

[11] 4,023,190

[45] May 10, 1977

[54] FILM PROCESSOR

[75] Inventor: Werner A. Fassler, Rochester, N.Y.

[73] Assignee: Sybron Corporation, Rochester, N.Y.

[22] Filed: June 2, 1975

[21] Appl. No.: 582,873

[52] U.S. Cl. ..... 354/319; 134/64 P; 354/324; 354/331

[51] Int. Cl.[2] ..... G03D 3/08; G03D 3/02; G03D 13/02

[58] Field of Search ..... 134/64 P, 122 P; 354/297, 319, 320, 321, 322, 324, 331, 336, 333

[56] References Cited

UNITED STATES PATENTS

| | | | |
|---|---|---|---|
| 1,998,154 | 4/1935 | Burns | 354/321 |
| 2,419,853 | 4/1947 | Pask | 354/319 X |
| 3,545,364 | 12/1970 | Reedy et al. | 354/319 X |
| 3,616,742 | 11/1971 | Boyle et al. | 354/319 X |
| 3,641,911 | 2/1972 | Aelterman et al. | 134/64 P |
| 3,662,660 | 5/1972 | Layne | 354/320 |
| 3,688,677 | 9/1972 | Frick et al. | 134/122 P |

*Primary Examiner*—Fred L. Braun
*Attorney, Agent, or Firm*—Theodore B. Roessel; Roger Aceto

[57] ABSTRACT

An X-ray film processor having a double tank construction wherein the drive rollers for transporting the film in a straight line horizontally through the processor are disposed in an upper film processing tank and above the normal level of the processing liquid in a lower, reservoir tank. A pump is used to artificially raise the level of the liquid in the upper tank to a level above the drive rollers so as to submerge both the drive rollers and the film being transported in the processing liquid.

7 Claims, 4 Drawing Figures

FILM PROCESSOR

BACKGROUND OF THE INVENTION

The present invention relates to film processors and more particularly to a processor wherein the film is transported horizontally through a series of processing stages.

Film processors which transport the film to be processed horizontally through a succession of processing stages are known in the art. Typical of such processes are those illustrated in U.S. Pat. Nos. 3,545,364; 3,293,775; and 2,419,853. In these prior art processors the processing liquid is applied to the film with an applicator usually taking the form of a small plenum chamber. The processing liquid is pumped from a reservoir to the plenum chamber where it washes, slashes or is sprayed against a film passing through the plenum chamber. As the applicator was relatively small and closely confined to the film, it was necessary to employ a number of applicators for each processing stage with the film transport means, such as drive rollers and the like, spaced between each applicator. Furthermore, the application of processing liquid to the film in this manner is usually highly agitated and fast flowing which is a condition not desirable in certain film processing situations.

The present invention allows for horizontal transport of the film to be processed through a succession of film processing stages. The level of the film processing liquid at each stage is raised during processing so as to submerge both the film and the film transport means in a processing liquid with little or no agitation.

SUMMARY OF THE INVENTION

The present invention may be characterized in one aspect thereof by the provision of an upper and lower tank defining a single film processing stage; film transport means disposed in the upper tank for horizontally transporting the film therethrough, the transport means being normally disposed above the level of liquid in the upper tank; and means for artifically raising the level of the liquid in the tank to a level above the transport means so that the transport means and the film being processed are submerged in the processing liquid.

OBJECTS OF THE INVENTION

One object of the present invention is to provide a film processor wherein the film to be developed is completely immersed in a processing liquid while moving through a horizontal path of travel.

Another object of the present invention is to provide a film processor wherein the film transport mechanism is normally disposed above the level of processing liquid when not in use and wherein the level of processing liquid is raised above the transport means when a film is being processed.

A further object of the present invention is to provide a film processor wherein the processing liquid undergoes a minimum of agitation and flow when in contact with the film to be processed.

Still another object of the present invention is to provide a film processor having a horizontal straight through transport wherein the level of processing liquid is artifically raised to the level of the transport means so as to submerge the film being processed.

These and other objects, advantages, and characterizing features of the present invention will become more apparent upon consideration of the following detailed description thereof when taken in connection with the accompanying drawings depicting the same.

DESCRIPTION OF THE PREFERRED EMBODIMENTS

Figure 1:
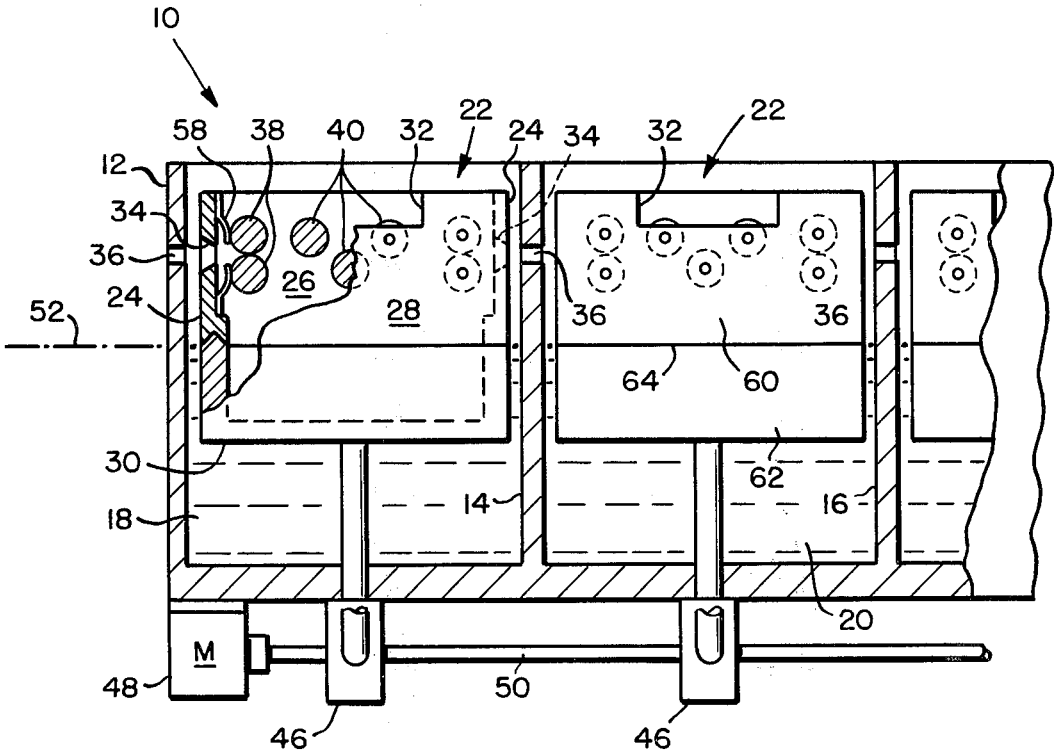

Referring to the drawings, FIG. 1 shows a portion of the processor generally indicated at 10. The processor includes the first outer tank 12 formed into reservoirs for holding the various processing liquids, such as developer, fixer and wash. Internal partitions or wall members 14 and 16 separate the process stages one from another and prevent the intermixing of the various processing liquids. While only two stages of the processor are illustrated in the figures it should be appreciated that the remaining stages will have a similar construction. Thus, with the arrangement shown in FIG. 1, the outer tank 12 and inner partitions 14 and 16 define a reservoir for the processing liquids such as developer solution 18 and a fixer solution 20.

Disposed within each reservoir section of the outer tank is an inner tank or processing module generally indicated at 22. Each module is formed by side walls 24, a rear wall 26, and a front wall 28 all upstanding from a base member 30. The front wall 28 is provided with a liquid outlet or weir opening 32 for purposes set forth hereinbelow. The side walls 24 are provided with slots 34 which accomodate the entrance and exit of the film being processed. It should be noted that slots 34 are in alignment with slots 36 in the side walls of the outer tank and internal partitions to permit the passage of film into and out of the processor and from one processing stage to another.

Figure 2:
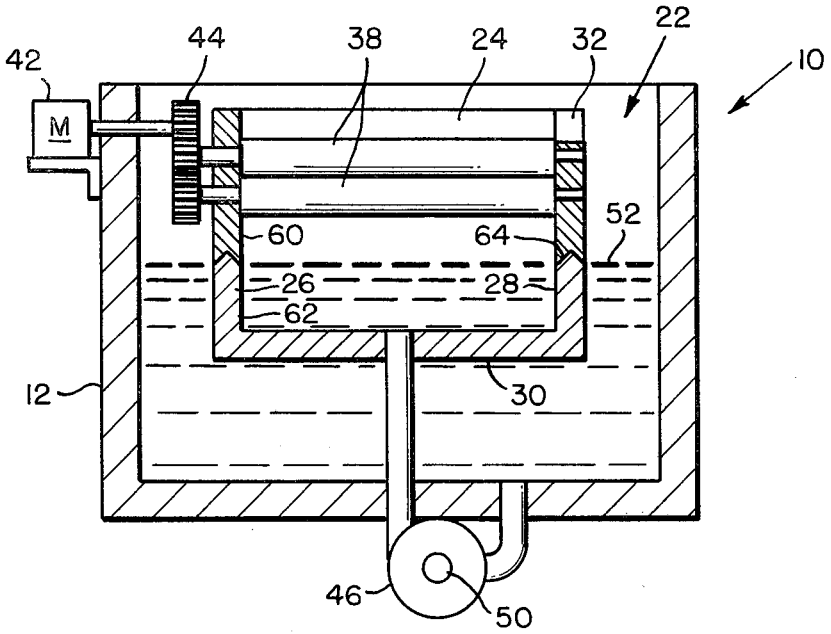
FIGS. 1 and 2 are schematic views showing the front and side elevation of the processor at a time when no film is being processed.

Carried adjacent the upper portion of each module is a series of horizontal rollers which comprise the transport means for guiding a film through the processor. Rollers 38 adjacent the entrance and exit of each module are preferably an opposed pair while the intermediate rollers 40 are staggered along and extend slightly into the path of travel so that a film is carried from one roller to another. Rotation of the rollers can be accomplished by any suitable means such as a motor 42 fixed to the outer tank and driving the rollers through a gear train 44 (FIG. 2). Completing the structure are pumps 46 provided for pumping process liquid from the reservoirs formed by the outer tank up into the inner tanks or processing modules. The pumps are preferably disposed outside of the outer tanks so that the all can be driven by a motor 48 from a common drive shaft 50.

Figure 4:
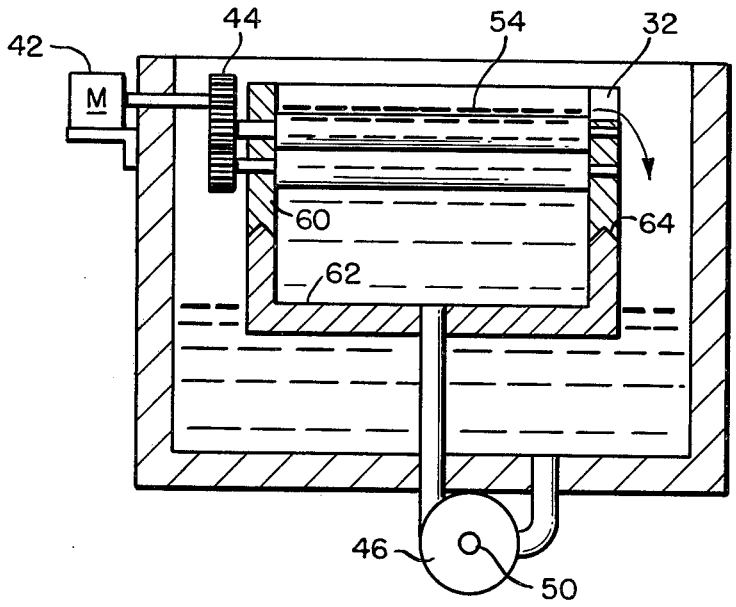
FIGS. 3 and 4 are similar to FIGS. 1 and 2 only showing a processor at a time when film is being processed.
Figure 3:
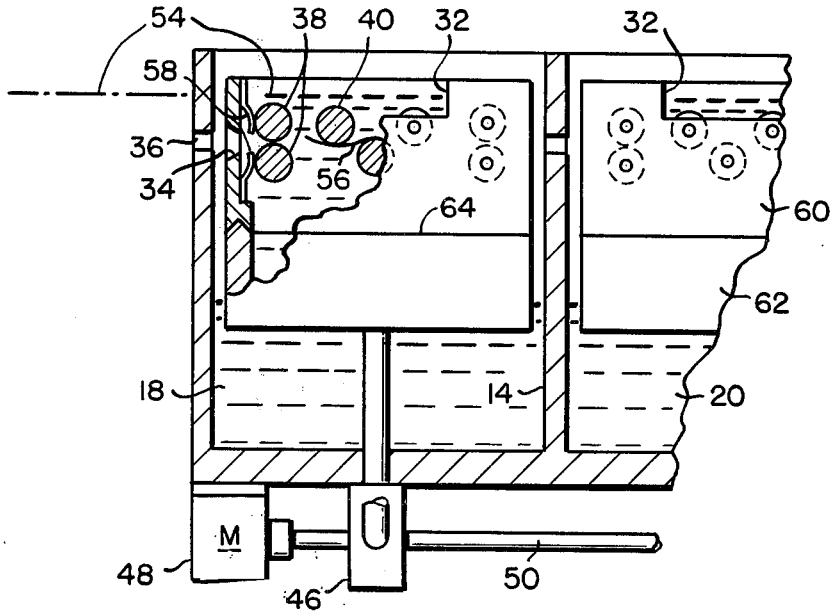

When the processor is not operating, the processing liquid in each stage seeks a level 52, which is somewhat below the level of the transport means (FIGS. 1 and 2). Thus, when the apparatus is not operating, the drive rollers which make up the transport means are maintained entirely out of the processing liquid. When the processing of film is desired, pumps 46 are operated so as to pump processing liquid from the reservoirs and into the processing modules or inner tanks. Under the head produced by pumps 46, the liquid rises in the inner tanks to a level 54 (FIGS. 3 and 4) above the transport means and spills over the outlet or weir 32 back into the reservoir of the outer tank. The processing liquids in the reservoir chambers are then simply recirculated by pumps 46 up into the processing modules. Since each module may have a cross-sectional area of 40 to 50 square inches, and an unobstructed vertical distance between the bottom 30 and the lowermost one of drive roller pair 38 (FIG. 2), an unobstructed volume is defined so that any agitation produced by the pump is substantially reduced by the time the processing liquid reaches level 54 so that there is little or no turbulance or agitation of the processing liquid in contact with the X-ray film. Instead there is simply an upflow of the processing liquid across the entire cross-sectional area of the module and then overflow from the module into the reservoir when the level of the weir is reached. This upflow allows both the drive rollers 38, 40 and a film 56 being processed to be submerged in the processing liquid (FIGS. 3 and 4).

As shown in the figures, the pair of rollers 38 positioned at the entrance and exit to each module are engaged so that there is little or no leakage of processing fluid from between the rollers. If the head produced by the pump is not sufficient to overcome the leakage around rollers 38 and out through slot 34 such leakage can be controlled by wipers 58 which extend from the side wall 24 of the module and wipe against each of the rollers.

When the operation of pump 46 is terminated, it is necessary for the processing liquid to drain from the module back to level 52 so as to maintain the transport means above the level of the processing liquid when the processor is not in use. This drainage can be accomplished simply by providing small drainage openings through the walls of the module. As shown in the drawings, however, it is preferred that each module be formed into an upper and a lower portion 60, 62 respectively. The upper portion then simply rests on the lower with a V-shaped or other tongue and groove joint 64 to position the upper portion on the lower. If this joint is not sealed, liquid will leak from the processing module back into the reservoir in order to reestablish the original level of processing liquid.

Having the processing module in two portions as described above also permits easy removal of the upper portion for cleaning the transport means. In this respect, the upper portion 60 is merely lifted from the lower portion and this exposes the transport means for periodic cleaning in order to remove any deposits of the processing chemicals.

Thus, it should be appreciated that the processor of the present invention accomplishes its intended objects in providing an arrangement wherein the means for transporting the film through a horizontal path of travel is normally disposed above the level of processing liquid when not in operation and wherein the level of processing liquid is artifically raised to a level above the transport means when the processor is in operation so as to submerge both the transport means and the film being processed in the processing liquid. The raising of the level of the processing liquid is accomplished with a minimum of agitation and turbulance. The separable construction of the processing module into upper and lower portions permits easy removal of the entire transport means for cleaning while at the same time providing a controlled leak which allows the processing liquid to drain from the module.

It should be appreciated that various modifications can be made in the invention as described. For example a drying stage has not been shown, however, a similar module, only employing a motor, fan and heater instead of a pump could be employed as the last stage.

Having thus described the invention in detail what is claimed as new is:

1. A film processor comprising:

a. a liquid tight reservoir for containing a supply of film processing liquid;

b. a non-liquid tight film processing tank supported in said reservoir above the bottom thereof, said tank having separable upper and lower portions resting one on the other with the junction therebetween affording means for liquid to flow between and seek a common level in said reservoir and film processing tank;

c. film transport means including a plurality of film engaging horizontally oriented drive rollers journaled at their ends to said upper portion above said common level of liquid for transporting a film in a straight line path of travel through said film processing tank; and d. a pump for pumping processing liquid from said reservoir into said film processing tank to raise the level of liquid in said film processing tank to a second level above said film path of travel, said pump producing sufficient head to maintain said second level as liquid tends to flow from said non-liquid tight processing tank and through said junction back into said reservoir.

2. A film processor comprising:

a. a reservoir for containing a supply of film processing liquid;

b. a film processing module defined by a bottom and upstanding side and end walls, said film processing module being in open communication with said reservoir so that liquid in said reservoir can establish a common liquid level in both said reservoir and film processing module;

c. a plurality of horizontally oriented drive rollers within said film processing module between said side walls and journaled at their ends to said end walls above said common liquid level, said drive rollers arranged to transport a film in a straight line path of travel through said film processing module;

d. said bottom and upstanding side and end walls of said film processing module defining an open and unobstructed volume below said drive rollers with the common liquid level being established intermediate said bottom and drive rollers;

e. a pump for pumping liquid from said reservoir and into said film processing module adjacent the bottom thereof for filling said volume and raising the level of liquid in said processing module to a second level above said film path of travel, the head produced by said pump being sufficient to maintain said film path of travel submerged in said liquid as liquid in said film processing tank attempts to seek said common level by flowing back into said reservoir through said open communication.

3. A film processor comprising:

a. double tank means including an outer tank defining a reservoir for a film processing liquid and an inner tank defining a film processing chamber;

b. horizontally oriented film transport means in said inner tank for engaging and moving a film in a straight line horizontal path of travel through said processor, said means being normally disposed above the level of processing liquid in said reservoir;

c. said inner tank having a liquid outlet located above the level of said path of travel;

d. pump means for pumping processing fluid from said reservoir and into said processing chamber to raise the level of liquid therein to said outlet; and e. said inner tank having upper and lower portions with said upper portion, including said transport means, being removable from said lower portion, the junction of said upper and lower portions providing a leakage means communicating with said outer tank to permit processing fluid to drain back into said reservoir and seek a level below said transport means when said pump is not operating.

4. A film processor comprising:

a. container means defining both a reservoir for processing fluid and a separate film processing chamber, said container means having aligned film entrance and exit slots at opposite ends thereof to permit the passage of a film into and out of said film processing chamber;

b. film transport means in said film processing chamber including a plurality of horizontally oriented film engaging drive rollers arranged to transport a film in a horizontal, straight line path of travel through said processor, said transport means being disposed above the normal level of processing fluid in said reservoir;

c. said film processing chamber being defined by a base and upstanding front, rear and side walls, said side walls having said film entrance and exit slots and said drive rollers being journaled to said front and rear walls;

d. said film processing chamber having weir means disposed above the level of said film path of travel and separable upper and lower portions, said upper portion, which includes said drive rollers, resting on and being removable from said lower portion, the junction of said upper and lower portions providing a leakage means to permit processing fluid to drain from said processing chamber and into said reservoir; and e. pump means for pumping processing fluid from said reservoir and into said film processing chamber to raise the level of processing liquid to said weir means, whereby said drive rollers and the film being transported thereby are submerged in said processing fluid.

5. A film processor as in claim 4 wherein said processing chamber is disposed within said reservoir.

6. A film processor as claim 4 wherein said container means has a plurality of internal partitions defining separate, isolated reservoirs for a developer, fixer and wash liquids, and a film processing chamber disposed in each of said separate reservoirs, said partitions and processing chambers having aligned slots to permit the passage of a film therethrough.

7. A film processor comprising:

a. a first reservoir tank for containing a supply a film processing liquid;

b. a second tank defining a film processing chamber, said second tank being disposed within said first tank and having an upper portion and a lower portion;

c. said lower portion comprising a base and upstanding front, rear and side walls retained in said reservoir tank and said upper portion comprising the upper extensions of said walls resting on and separable from said lower portion, the junction between said upper and lower portions producing a leakage means to permit the processing liquid in said reservoir to leak between said upper and lower portions to establish a common liquid level;

d. the upper extensions of said side walls having aligned slots to permit the passage of a film through said processing chamber;

e. film transport means including a plurality of horizontally oriented film engaging drive rollers for transporting a film in a straight line path of travel from one of said slots to another, said drive rollers having the ends thereof journaled to the upper extensions of said front and rear walls; and f. a pump for pumping processing liquid from said reservoir and into said processing chamber, said pump producing sufficient head to overcome leakage of liquid from said chamber to raise the level of processing liquid in said chamber from said common level below said drive rollers to a second level above said film path of travel whereby said film and at least a portion of said drive rollers are submerged in processing liquid.

* * * * *

UNITED STATES PATENT AND TRADEMARK OFFICE

CERTIFICATE OF CORRECTION

PATENT NO. : 4,023,190

DATED : May 10, 1977

INVENTOR(S) : Werner Fassler

It is certified that error appears in the above-identified patent and that said Letters Patent are hereby corrected as shown below:

Claim 7, line 2, "a" second occurrence, should be -- of --.

Signed and Sealed this

*Eleventh* Day of *October 1977*

[SEAL]

*Attest:*

RUTH C. MASON
*Attesting Officer*

LUTRELLE F. PARKER
*Acting Commissioner of Patents and Trademarks*